US009520692B2

(12) United States Patent
Valenti et al.

(10) Patent No.: US 9,520,692 B2
(45) Date of Patent: Dec. 13, 2016

(54) AUDIO VISUAL FACEPLATE WITH INTEGRATED HINGED TERMINATION METHOD FOR CIRCULAR CONNECTOR

(71) Applicant: Panduit Corp., Tinley Park, IL (US)

(72) Inventors: Joshua A. Valenti, Wheeling, IL (US); Robert E. Fransen, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/607,142

(22) Filed: Jan. 28, 2015

(65) Prior Publication Data

US 2015/0221421 A1 Aug. 6, 2015

Related U.S. Application Data

(60) Provisional application No. 61/934,234, filed on Jan. 31, 2014, provisional application No. 62/031,927, filed on Aug. 1, 2014.

(51) Int. Cl.

| | |
|---|---|
| ***H01R 43/28*** | (2006.01) |
| ***H01R 4/24*** | (2006.01) |
| ***H01R 13/447*** | (2006.01) |
| *H01R 4/22* | (2006.01) |

(52) U.S. Cl.

CPC ..... *H01R 43/28* (2013.01); *H01R 4/2416* (2013.01); *H01R 13/447* (2013.01); *H01R 4/22* (2013.01); *Y10T 29/49174* (2015.01)

(58) Field of Classification Search

CPC ..... H01R 4/2412
USPC ..... 439/409, 414, 404
See application file for complete search history.

(56) References Cited

U.S. PATENT DOCUMENTS

| | | | | |
|---|---|---|---|---|
| 6,152,760 A * | 11/2000 | Reeser | H01R 4/2433 | 439/395 |
| 6,406,324 B1 * | 6/2002 | Duesterhoeft | H01R 4/2433 | 439/409 |
| 7,452,245 B2 * | 11/2008 | Doorhy | H01R 13/6463 | 439/456 |

* cited by examiner

*Primary Examiner* — Phuong Dinh
(74) *Attorney, Agent, or Firm* — Christopher S. Clancy; James H. Williams; Christopher K. Marlow

(57) ABSTRACT

A communication system has a support and a communication connector attached to the support wherein the connector assembly has a termination lever. The system can further include a wire cap connected to a plurality of cable conductors. The wire cap can include a cover cap. The cover cap latches to the connector assembly when the wire cap and the plurality of cable conductors is terminated to the communication connector assembly. The support can be one of a faceplate, a patch panel, a surface mount box, or a media distribution unit.

12 Claims, 30 Drawing Sheets

SECTION B-B

SECTION C-C

SECTION D-D

SECTION D-D

AUDIO VISUAL FACEPLATE WITH INTEGRATED HINGED TERMINATION METHOD FOR CIRCULAR CONNECTOR

CROSS REFERENCE TO RELATED APPLICATIONS

This application claims the benefit of U.S. Provisional Patent Application Ser. No. 61/934,234, filed Jan. 31, 2014 and U.S. Provisional Patent Application Ser. No. 62/031,927, filed Aug. 1, 2014, which are incorporated herein by reference in their entirety.

FIELD OF THE INVENTION

The present invention relates generally to wiring for audio visual installations and specifically to a wiring solution for audio visual installations that uses 4-twisted pair cabling.

BACKGROUND OF THE INVENTION

The AV (audio visual) market is expanding due to increased use of computer graphics and visual telecommunication media in educational, business, healthcare, government, and other applications. There are a variety of cable and connector types such as VGA, RCA, 3.5 mm, and digital connections such as HDMI, and these connectors are generally not field terminable. Another problem with these solutions is that the connectors generally are not suitable for pulling through an electrical conduit, and consequently are not suitable for a pre-configured solution, i.e., a cable assembly employing such connectors generally are not suitable for pre-assembly offsite and then installation as an assembly at the installed location.

SUMMARY OF THE INVENTION

In one embodiment, a communication system has a support and a communication connector attached to the support wherein the connector assembly has a termination lever.

In some embodiments, the system can further include a wire cap connected to a plurality of cable conductors. The wire cap can include a cover cap.

In some embodiments, the cover cap latches to the connector assembly when the wire cap and the plurality of cable conductors is terminated to the communication connector assembly.

In some embodiments, the support can further include a mounting surface for mounting the communication connector assembly, and the communication connector assembly can include a port for receiving the wire cap and the plurality of cable conductors such that a central axis of the port is non-normal to the front surface. In some embodiments the central axis can be 45° to the front surface.

In some embodiments, the communication connector assembly can further include a plurality of isolated quadrants within the port.

In some embodiments, the wire cap can include at least one pair of a primary hook and a respective secondary hook for at least one of the plurality of cable conductors such that the pair inhibits a respective connected conductor release.

In some embodiments, the wire cap includes a divider crossbar and the divider crossbar can include cable posts.

In some embodiments, the support is at least one of a faceplate, a patch panel, a surface mount box, and a media distribution unit.

In one embodiment, a method of connecting a communication cable to a communication connector assembly includes the steps of: wire mapping a plurality of conductors into a wire cap, inserting the wire cap into the communication connector assembly, pressing a termination lever of the communication connector assembly onto the wire cap, and terminating the plurality of conductors into the communication connector assembly.

In some embodiments, the termination step also connects each of the plurality of conductors to respective ones of a plurality of insulation displacement contacts.

In one embodiment, a wire cap for terminating a plurality of conductors of a communication cable to communication connector has at least one pair of a primary hook and a respective secondary hook for at least one of the plurality of cable conductors such that at least one the pair having the primary hook is oriented opposite to respective the secondary hook.

In some embodiments, the primary hook and the respective secondary hook inhibit a respective connected the conductor release.

In some embodiments, the wire cap includes a divider crossbar and the divider crossbar can include cable posts.

In one embodiment, a wire cap assembly for terminating a plurality of conductors of a communication cable to communication connector has a wire cap having a termination cap including a plurality of termination slots and a protective cover having integral tabs which align with respective the termination slots.

In some embodiments, the integral tabs inhibit movement of the plurality of conductors.

In one embodiment, a communication system can include a support and a communication connector assembly connected to the support. The connector assembly can include a female connector assembly configured for receiving a plurality of cable conductors with a central axis of the female connector assembly being non-normal to the front surface. The female connector assembly can further include a plurality of isolated quadrants.

DETAILED DESCRIPTION OF THE PREFERRED EMBODIMENTS

The present invention is a circular connector that utilizes twisted pair cabling that can either be field or factory terminated depending on customer preference, can be fed through conduit with a pull cap without damage to the connector, is fully shielded, and may be utilized in a pre-configured AV solution. The present invention utilizes an integrated hinged termination method that provides for a fast termination while securing the connector. The connector on the back of the faceplate is angled such that cable management is easier as to not violate cable bend radius requirements.

Figure 1:
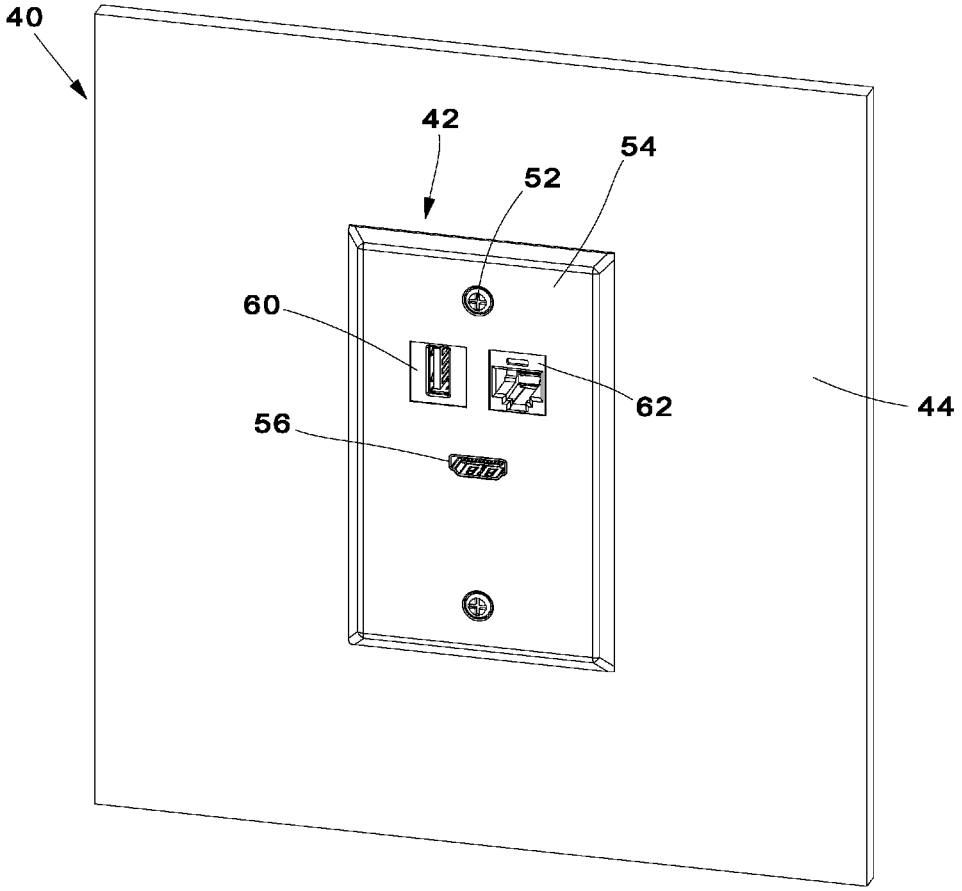
FIG. 1 is a front isometric view of an audio visual faceplate with an integrated hinged termination method for a circular connector.
Figure 2:
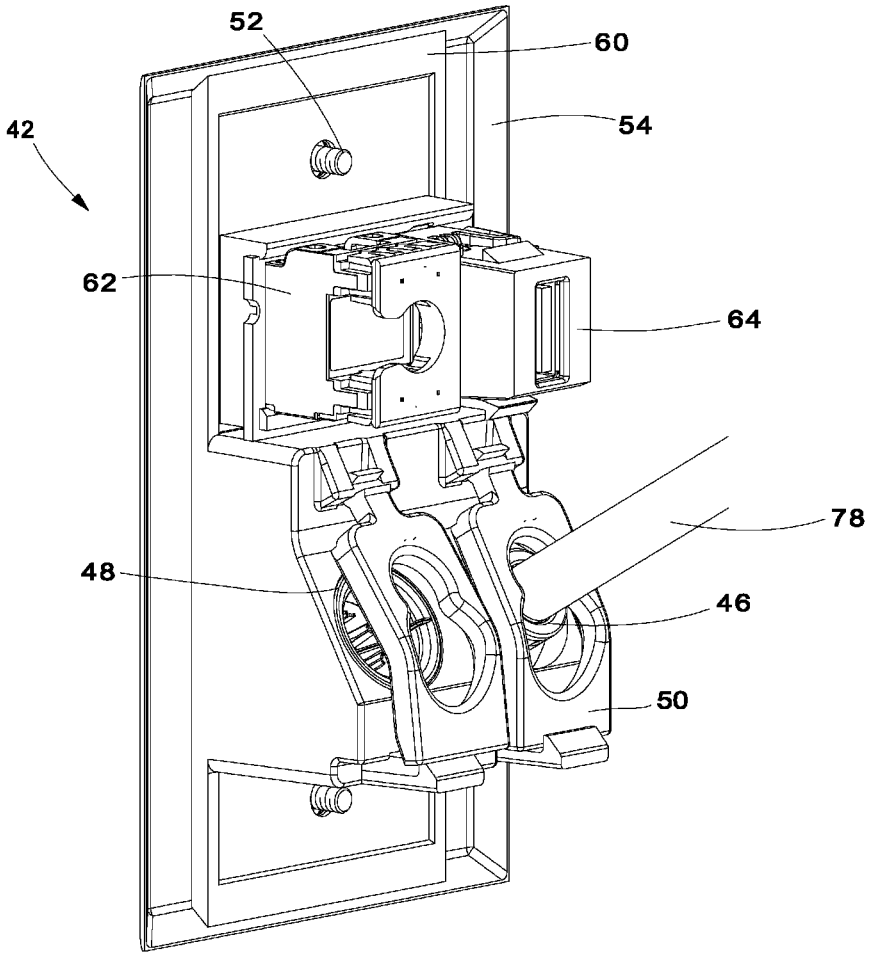
FIG. 2 is a rear isometric view of the audio visual faceplate of FIG. 1

FIG. 1 is a front isometric view of communication system 40, according to the present invention, which includes faceplate assembly 42 connected to wall 44. FIG. 2 is a rear isometric view of communication system 40 (wall 44 has been removed for clarity) in which a circular wire cap assembly 46 is connected to female connector assembly 48 on the rear of faceplate assembly 42, via termination lever 50. In a complete installation patch and/or horizontal cable assemblies typically are installed on the back and front of the faceplate in order to complete communication system 40, the exclusion of these is not limiting and any form of patching/cabling method may be used to complete the final assembly.

Figure 3:
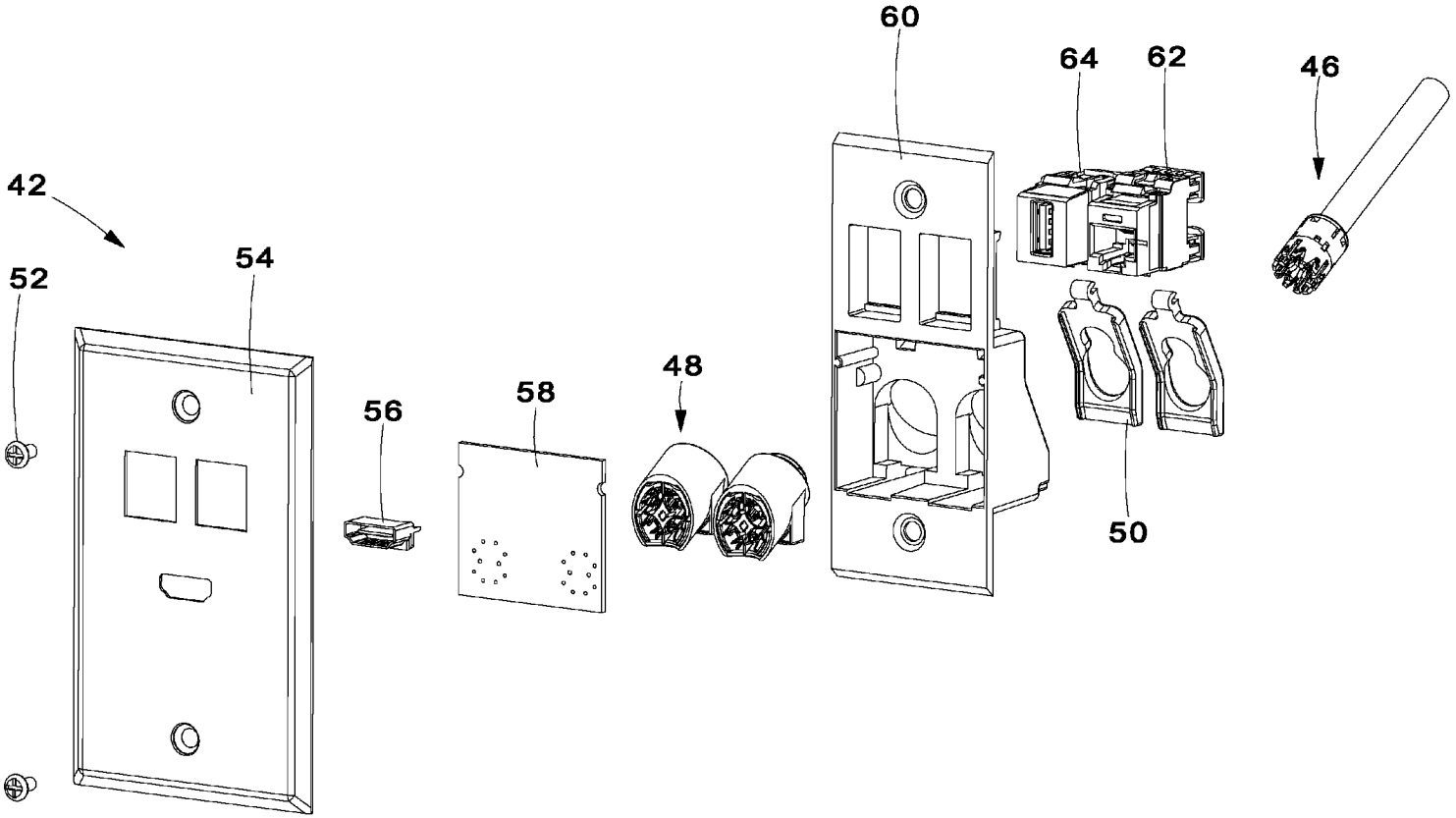
FIGS. 3 and 4 are exploded views of the faceplate of FIG. 1.
Figure 4:
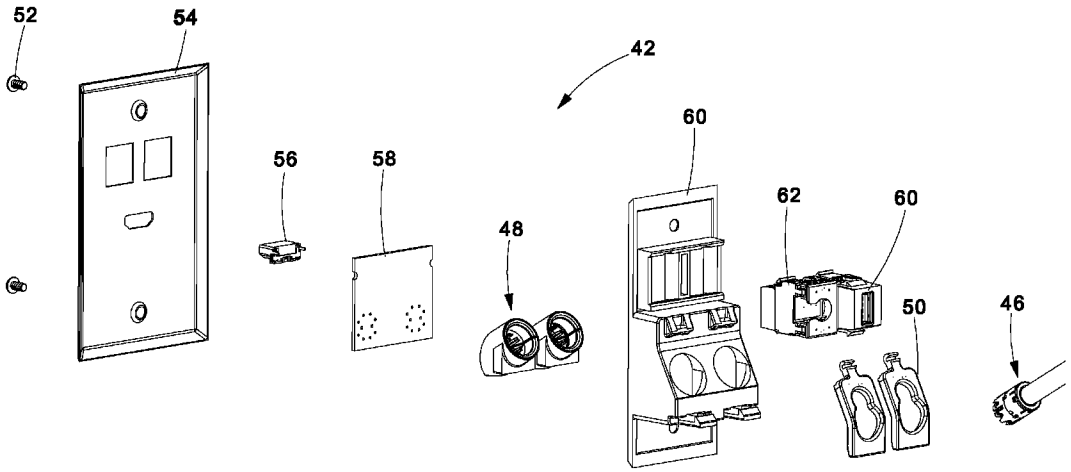

Referring now to FIG. 3 and FIG. 4, exploded views of faceplate assembly 42 (front and rear isometrics respectively) includes screws 52, faceplate 54, connector 56, circuit board 58, faceplate backing 60, keystone RJ45 jack 62, keystone USB coupler 64, termination levers 50, female connector assembly 48, and circular wire cap assembly 46. Keystone RJ45 jack 62 and keystone USB coupler 64 are shown but may include any non-limiting variety of keystone modules. Connector 56 is shown as an HDMI connector; however, other non-limiting connectors may be routed through female connector assembly 48 and circuit board 58, examples of which include RCA, VGA, DVI, and stereo connectors.

Figure 5:
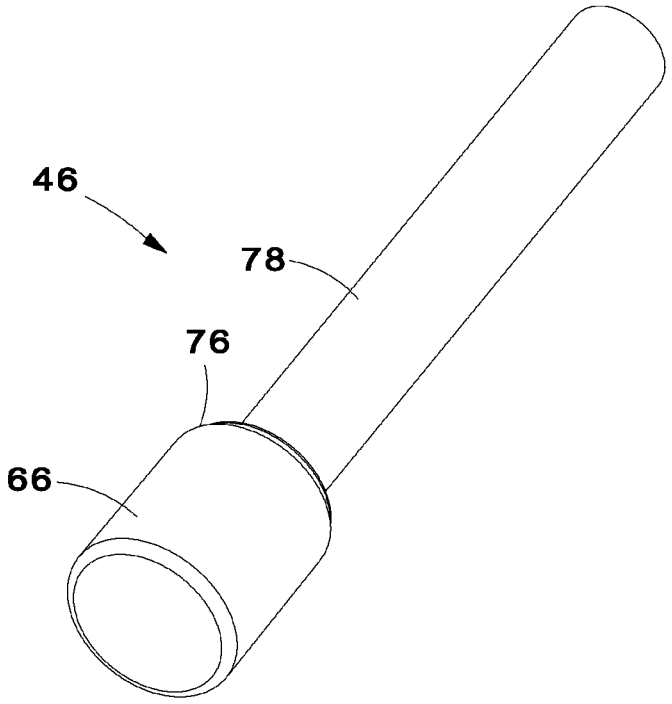
FIG. 5 is an isometric view of a circular connector assembly for use with the audio visual faceplate of FIG. 1.
Figure 6:
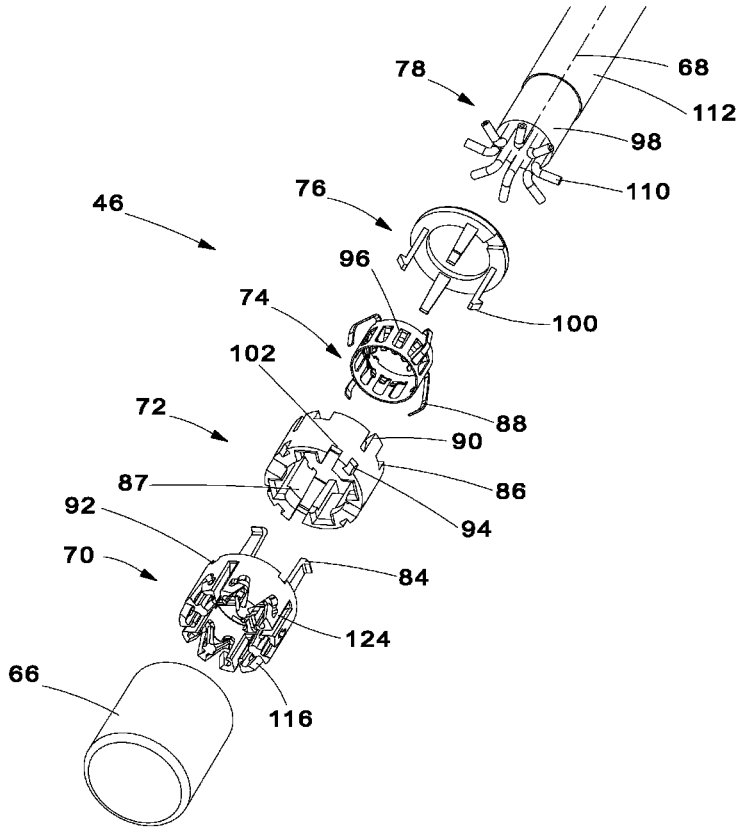
FIG. 6 is a front isometric view of the circular connector assembly of FIG. 5 exploded along the central axis.
Figure 7:
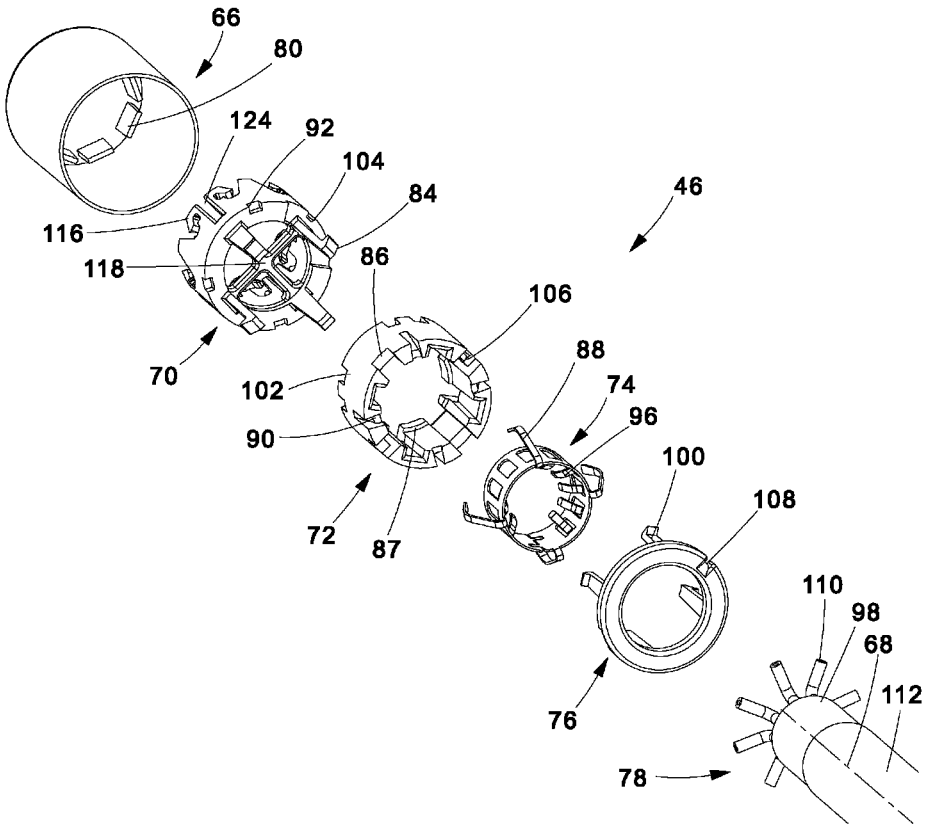
FIG. 7 is a rear isometric view of the circular assembly of FIG. 5 exploded along the central axis.

FIG. 5 is an isometric view of circular wire cap assembly 46, which is protected by pulling cap 66. FIG. 6 is a front isometric view of circular wire cap assembly 46 and pulling cap 66 that is exploded along central cable axis 68. FIG. 7 is a rear isometric view of circular connector assemblies 46 and pulling cap 66 that is exploded about central cable axis 68. Circular wire cap assembly 46 includes wire termination cap 70, connecting block 72, grounding ring 74, cover cap 76, and twisted pair cable 78. Twisted pair cable 78 is shown as a shielded twisted pair cable but termination can be achieved with an unshielded termination cable as well in circular wire cap assembly 46. Pulling cap 66 has tabs 80 that align with termination slots 82 (FIG. 10) on termination cap 70. Termination cap 70 secures to connecting block 72 via latches 84 which align with latch pockets 86. Grounding ring 74 bottoms out on ledge 87 when placed in connecting block 72. Grounding base tabs 88 align with pockets 90 during assembly. Once terminated grounding base tabs 88 deflect and consequently increase in length along central cable axis 68. Recessed pockets 92 on termination cap 70 and recessed pockets 94 on connecting block 72 allow for this extension and prevent grounding base tabs 88 from being tangled during installation or while feeding circular wire cap assembly 46 thru conduit. Grounding cable tabs 96 make contact with cable braid 98 during assembly to make the connection between circular wire cap assembly 46 and cable braid 98. Flexible latches 100 on cover cap 76 align with latch pockets 102 on connecting block 72. Once cover cap 76 is installed it prevents grounding ring 74 from being removed from wire cap assembly 46. Circular wire cap assembly 46 needs to be keyed such that during assembly it is in the correct orientation with respect to female connector assembly 48. In order to accomplish this alignment, slot 104 on termination cap 70 aligns with alignment slot 106 on connecting block 72 which aligns with alignment slot 108 on cover cap 76. Twisted pair cable 78 includes conductors 110, cable braid 98, and cable jacket 112.

Figure 8:
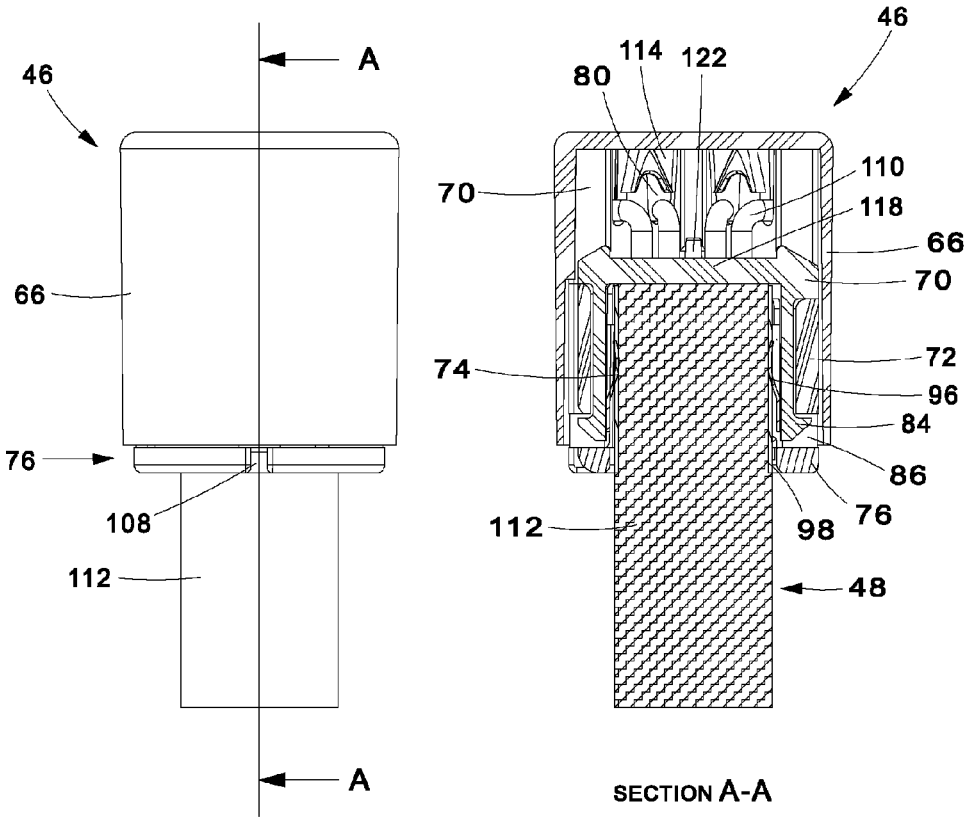
FIG. 8 is a cross-sectional view of the circular assembly of FIG. 5.

FIG. 8 is a cross-section view of circular wire cap assembly 46 protected by pulling cap 66. From this view it can be seen that tabs 80 align with termination slots 82 such that conductors 110 are compressed and held in place during installation thru conduit. Also, primary wire hooks 114 can be seen such that conductors 110 are underneath and further hold conductors 110 during installation through conduit.

Figure 9:
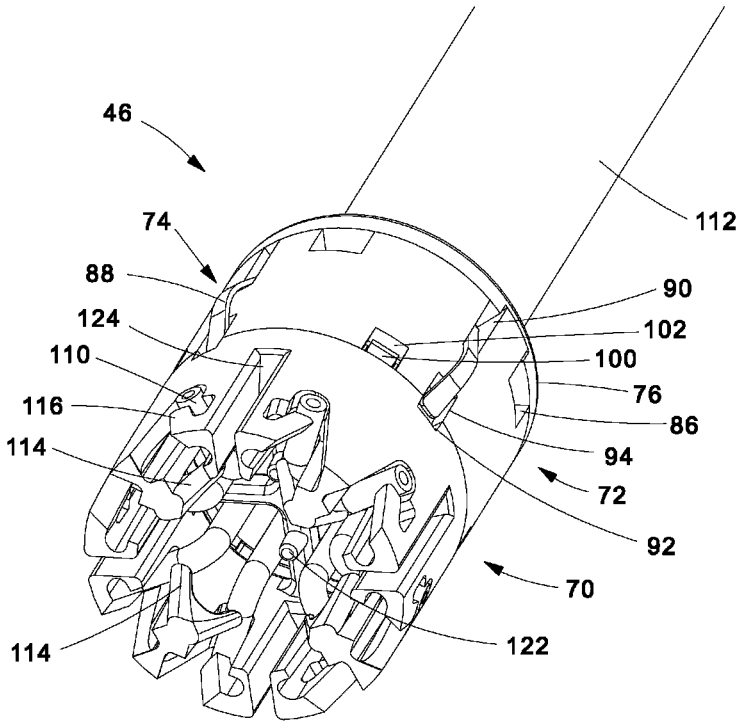
FIG. 9 is an isometric view of the circular connector assembly without a pulling cap.
Figure 10A:
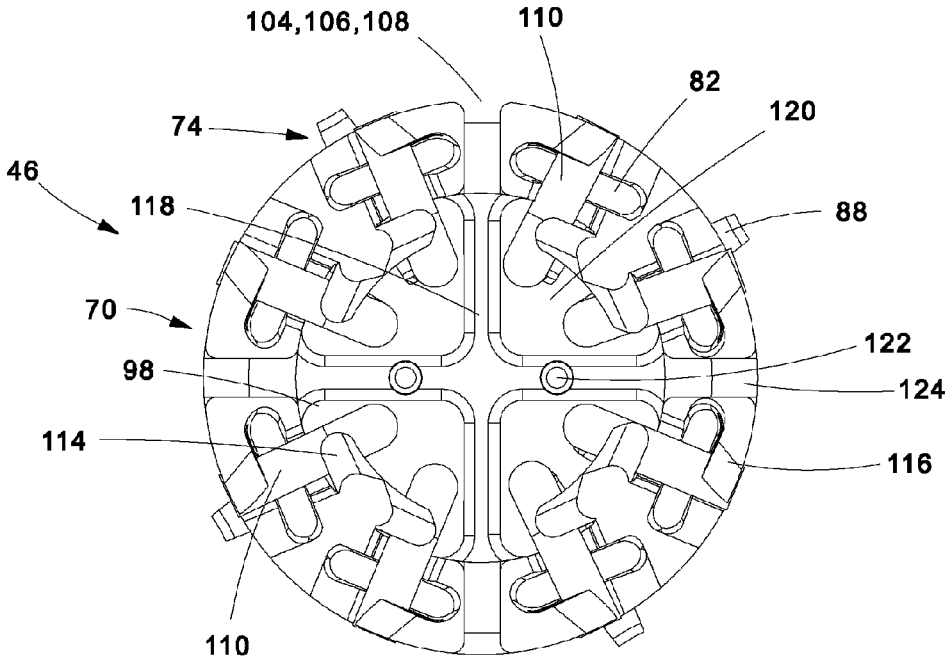
FIGS. 10*a* and 10*b* are top views of the circular connector assembly of FIG. 9 (FIG. 5 without the pulling cap).
Figure 10B:
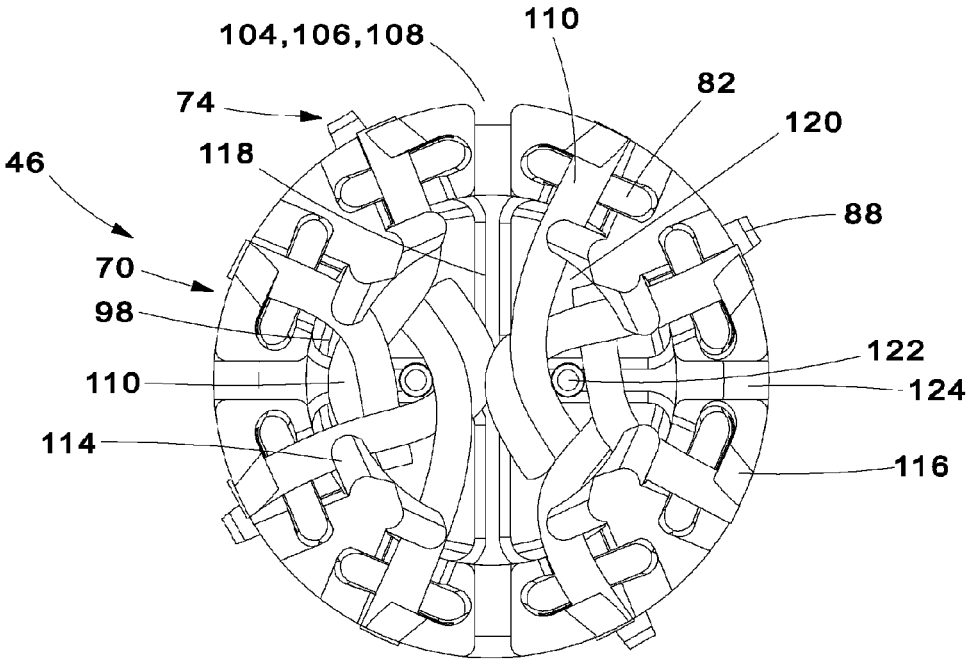

FIG. 9 is an isometric view of circular wire cap assembly 46, (this is similar to FIG. 5 but with pulling cap 66 removed). FIG. 10*a* and FIG. 10*b* is a top view of circular wire cap assembly 46 along central cable axis 68. Conductors 110 align with termination slots 82, such that each conductor 110 fits into a separate termination slot 82. Both primary wire hooks 114 and secondary wire hooks 116 flex out of the way during conductor 110 assembly and help secure conductors 110 during both install and termination. Primary wire hooks 114 and secondary wire hooks 116 flex in opposite directions such that during installation conductor 110 is fed through one hook at a time. Primary wire hooks 114 and secondary wire hooks 116 are in opposite directions to insure that no conductor 110 falls out of wire slot 82 during installation. Cable divider 118 has a twofold purpose in that it controls the depth at which cable 78 is inserted into circular wire cap assembly 46 and separates conductor pairs 110 into individual quadrants 120. Cable posts 122 on cable divider 118 control the variation in wire cap assembly 46, by controlling the spacing and orientation of conductor pairs 110 on opposite ends of cable 48. One end of cable 48 is shown in FIG. 10*a* and the opposite end of the cable in which conductors 110 need to cross is shown in FIG. 10*b*. Alternate non-limiting wiring patterns can be achieved through different routings on circuit board 58. Relief slots 124 on termination cap 70 align with grounding spacers 126 on grounding base 128 of female connector assembly 48.

Figure 11:
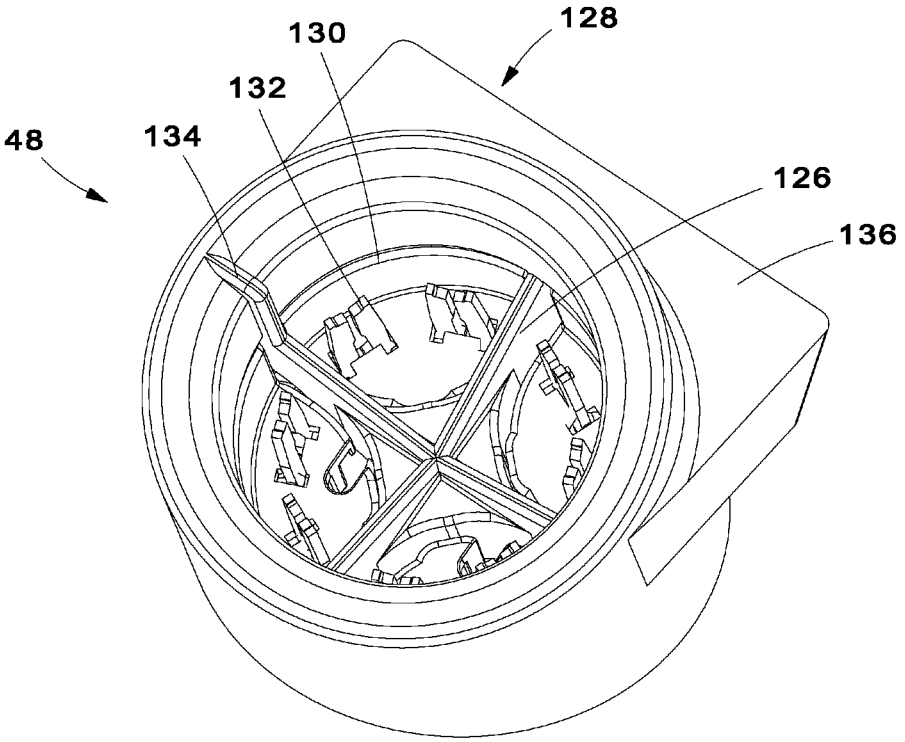
FIG. 11 is a front isometric view of a female connector assembly for use with the audio visual faceplate of FIG. 1.
Figure 12:
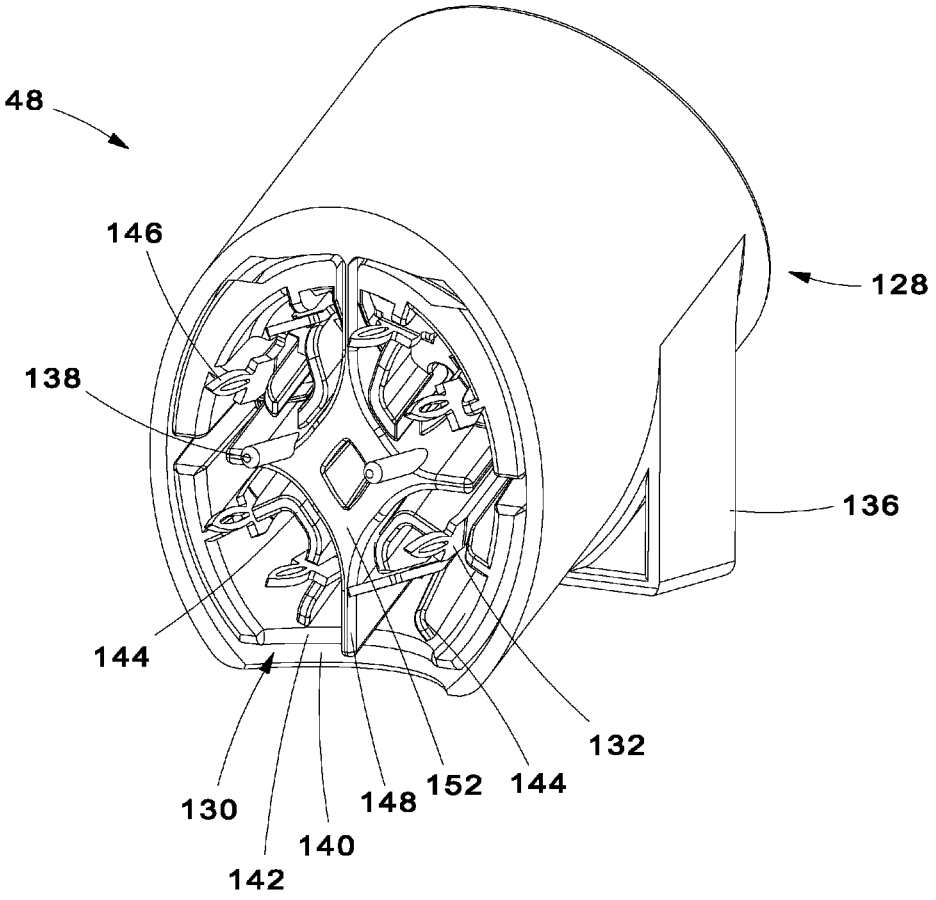
FIG. 12 is a rear isometric view of the female connector assembly of FIG. 11.
Figure 13:
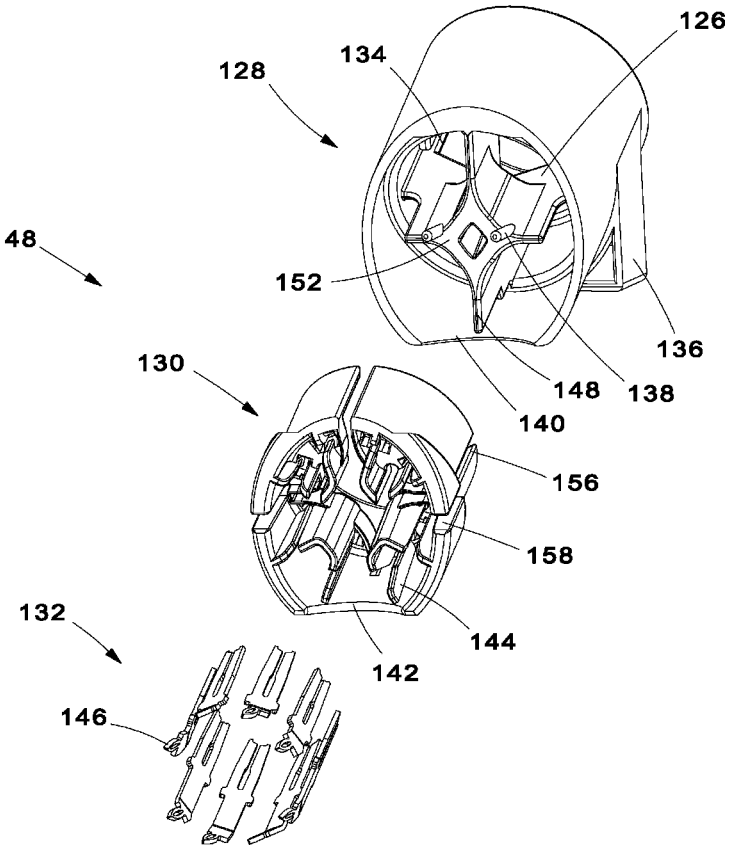
FIG. 13 is an exploded rear isometric view of the female connector assembly of FIG. 11.
Figure 14:
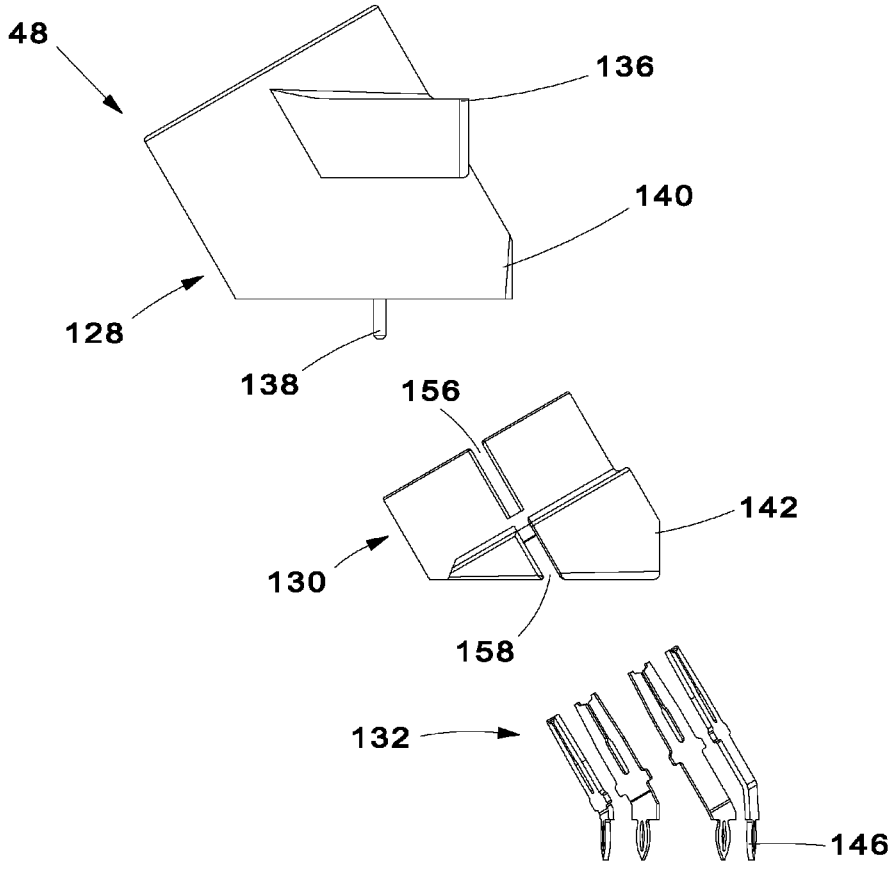
FIG. 14 is an exploded side view of the female connector assembly of FIG. 11.

FIG. 11 is a front isometric view of female connector assembly 48, and FIG. 12 is a rear isometric view of female connector assembly 48. Female connector assembly 48 includes grounding base 128, standoff 130, and eight IDCs 132. FIG. 13 is an exploded rear isometric view of female connector assembly 48. FIG. 14 is an exploded side view of female connector assembly 48. Grounding base 128 has keying rib 134 which aligns with alignment slot 104, 106, and 108, which insure circular wire cap assembly 46 is correctly aligned with female connector assembly 48. Ledge 136 on grounding base 128 is used for manufacturing purposes such that it gives a flat edge for handling and a place to push on when inserting female connector assembly 48 into circuit board 58. In order to complete the ground connection between female connector assembly 48 and circuit board 58, posts 138 on female connector assembly are pressed into circuit board 58. Posts 138 are shown as a solder connection but may be secured to circuit board 58 by other non-limiting ways such as a press fit. Cutout 140 on grounding base 128 and cutoff 142 on standoff 130 shorten the overall length of the connector assembly 48 which saves space on circuit board 58. Support ribs 144 on standoff 130 support IDCs 132 from buckling when compliant pins 146 of IDCs 132 are pressed into circuit board 58. IDCs 132 are shown with compliant pins 146 for being secured to the circuit board but may use other non-limiting ways of being secured to the circuit board such as soldering. Grounding spacers 126 on grounding base 128 align with relief slots 124 on termination cap 70 such that each pair of conductors 110 is isolated during termination from the adjacent pair of conductors 110. Grounding spacers 126 are angled towards the center to allow for the end to end effect of twisted pair cables and let pairs of conductors 110 crossover on opposite ends of female connector assembly 48. Grounding bars 148 of grounding base 128 are below surface 150 (see FIG. 15) of standoff 130, and isolate IDC pairs 132 from each other similar to how grounding spacers 126 isolate conductor pairs 110 above surface 150. Center divider 152 of grounding base 128 creates a uniform spacing between ground and IDC pairs 132. IDCs 132 are a mirror image about datum 154 (shown as cross-section B-B of FIG. 17), so as to keep a uniform spacing to ground and reduce the amount of unique components within female connector assembly 48. Cutouts 156 on standoff 130 align with grounding spacers 126, and cutouts 158 align with grounding bars 148 to allow for clearance between standoff 130 and grounding base 128.

Figure 15:
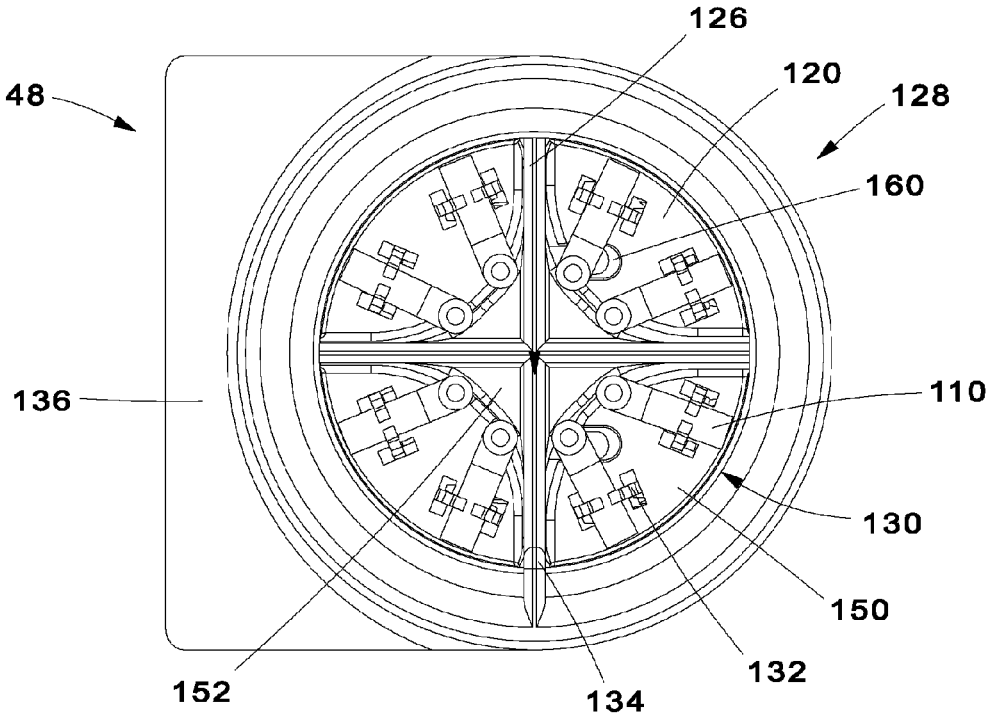
FIG. 15 is a top view of the female connector assembly of FIG. 11 with terminated conductors shown.
Figure 16:
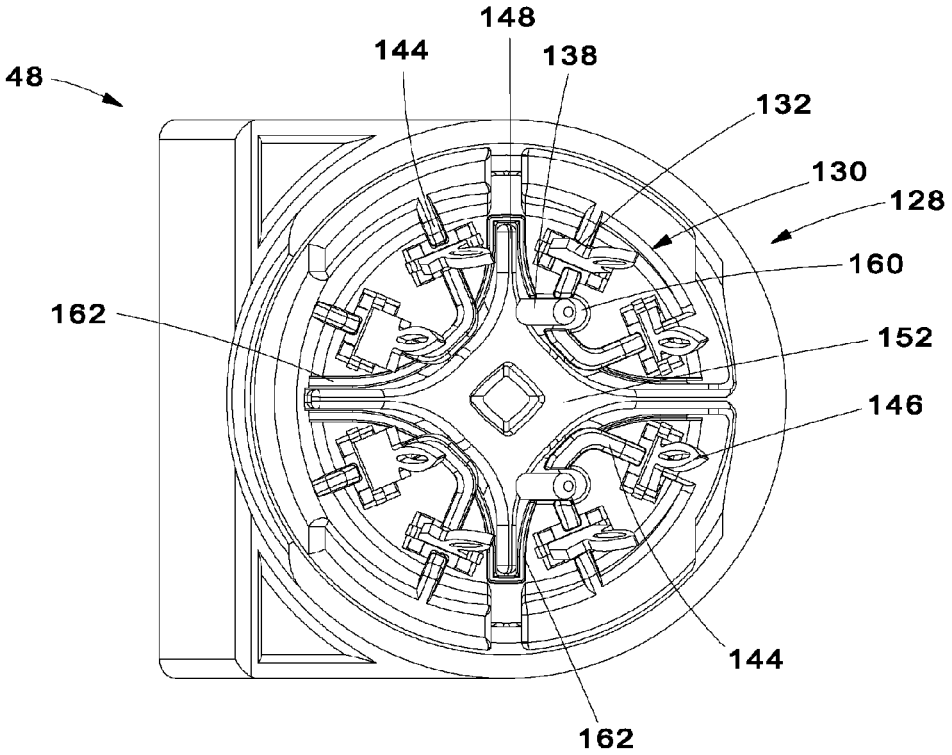
FIG. 16 is a bottom view of the female connector assembly of FIG. 11.

FIG. 15 is a top view of female connector assembly 48; this is the same orientation as circular wire cap assembly 46 would be installed along central cable axis 68. FIG. 15 shows the isolation of pairs of conductors 110 due to grounding spacers 126. FIG. 16 is a bottom view of female connector assembly 48; this is the same orientation as circular wire cap assembly 46 is installed along central cable axis 68. This is also the orientation in which standoff 130 is loaded into grounding base 128, and IDCs 132 are loaded into standoff 30 along central cable axis 68 to complete female connector assembly 48. Cutouts 160 in standoff 130 allow for posts 138 to not interfere during assembly. Ribs 162 add material between grounding base 128 and IDCs 132 so as to reduce chances of failure during dielectric withstand voltage or "Hipot" testing.

Figure 17:
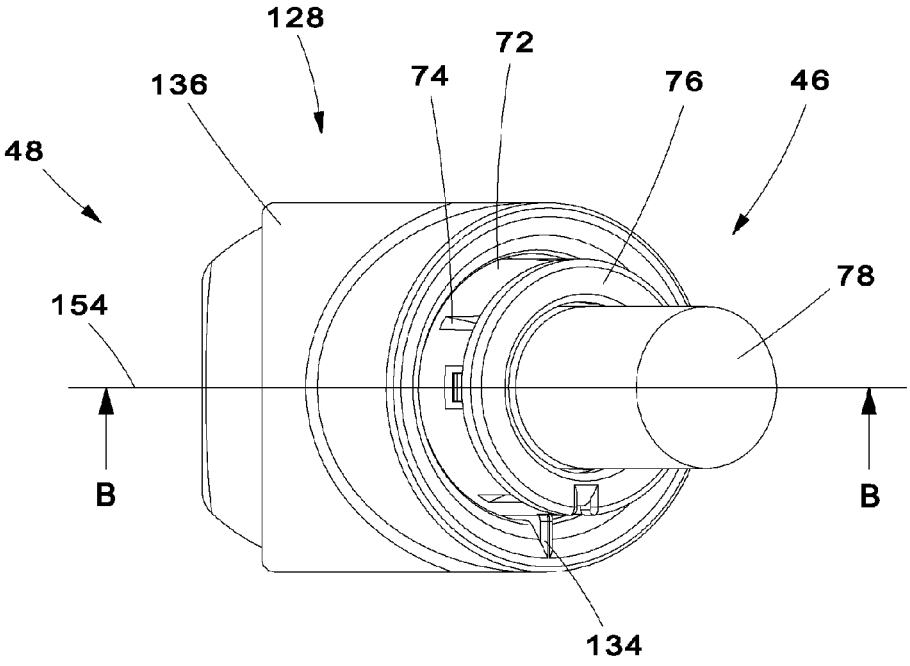
FIG. 17 is a top view of the circular connector assembly of FIG. 5 mated to the female connector assembly of FIG. 11.
Figure 18:
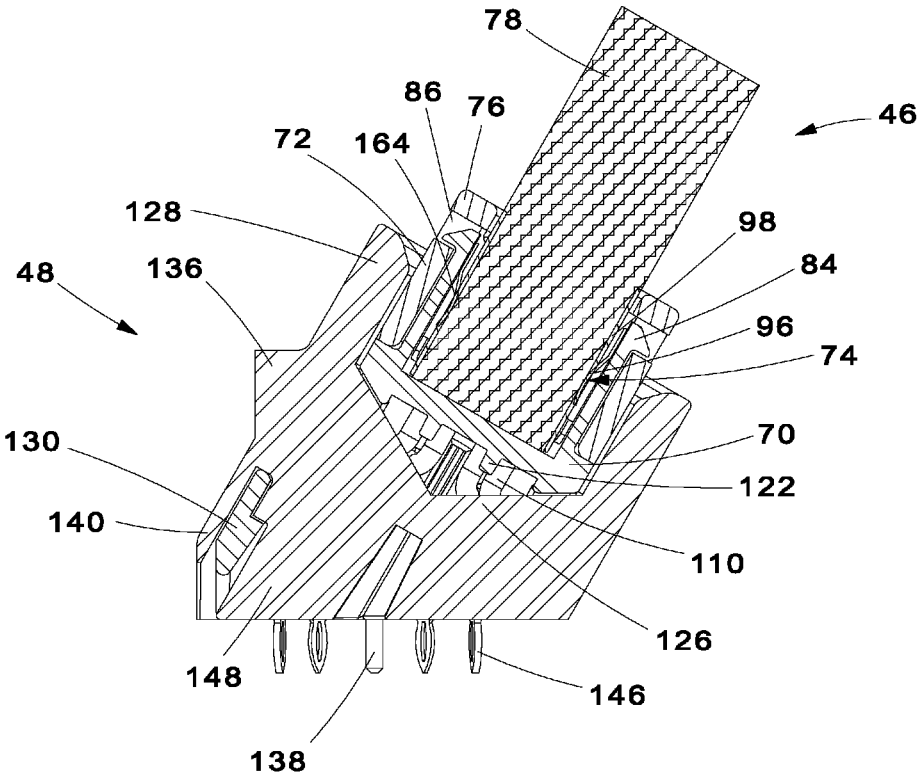
FIG. 18 is a cross-sectional view of the mated connectors of FIG. 17 taken along line B-B.
Figure 19:
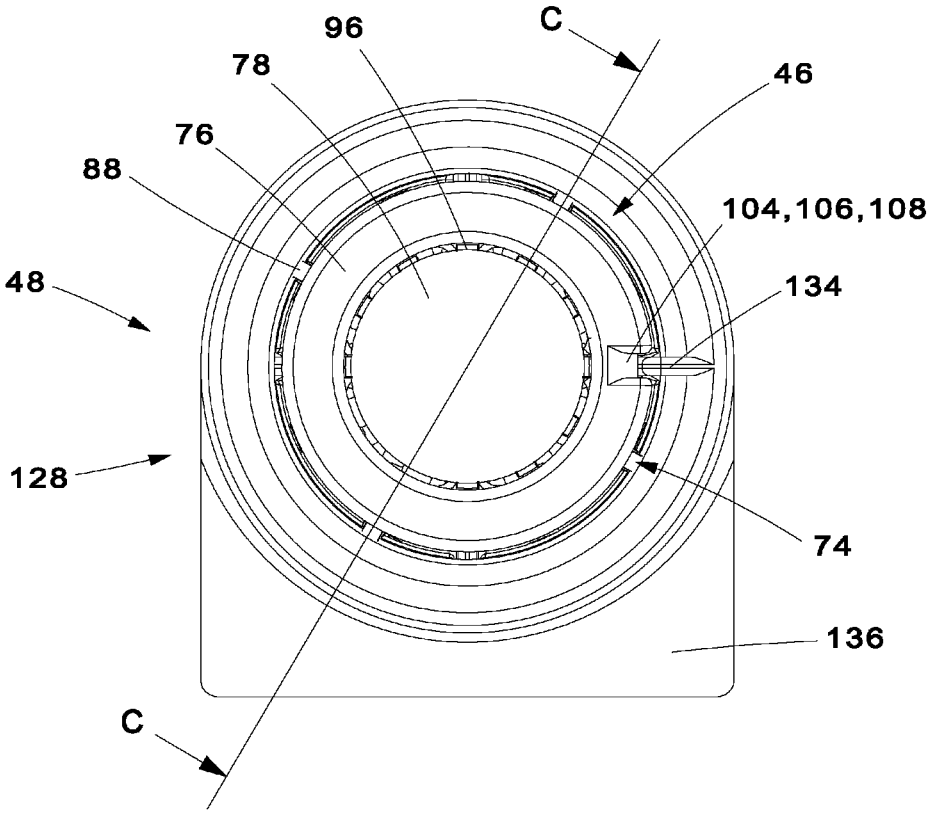
FIG. 19 is a top view of the mated connector assembly of FIG. 17 showing the keying of the connectors.

FIG. 17 is a top view of female connector assembly 48 and circular wire cap assembly 46. FIG. 18 is a cross-section B-B from FIG. 17 of the assembly of female connector assembly 48 and circular wire cap assembly 46. FIG. 18 view further demonstrates the isolation of pair of conductors 110 due to grounding spacers 126, and also shows the relative space in the center of grounding spacers 126 due to the angled center to allow for crossover pairs on opposite ends of female connector assembly 48. FIG. 19 is a top view that demonstrates how female connector assembly 48 is keyed during the installation of circular wire cap assembly 46 via keying rib 134 which aligns with alignment slots 104, 106, and 108.

Figure 20:
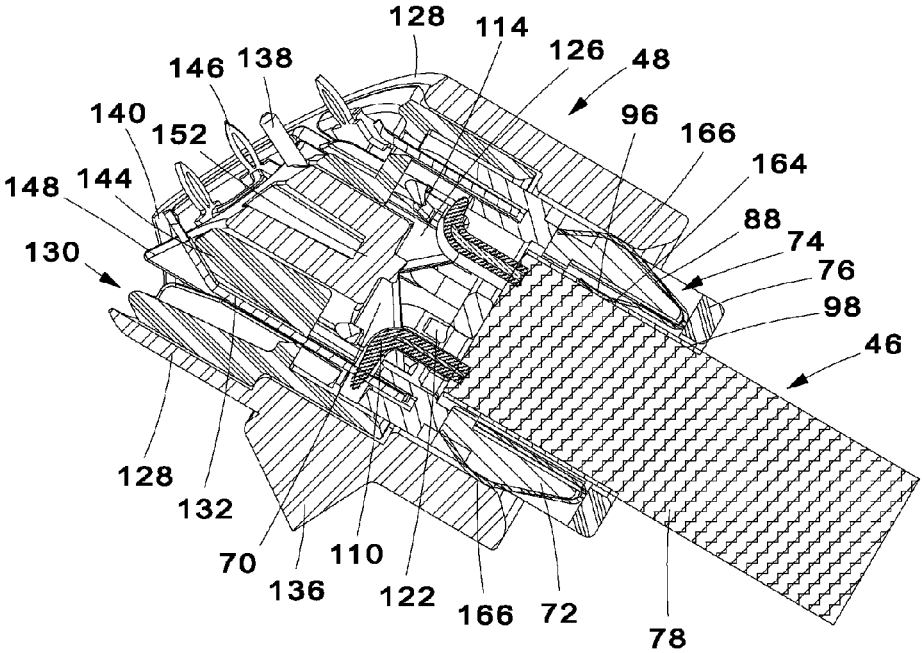
FIG. 20 is a cross-sectional view of the mated connectors of FIG. 17 taken along line C-C of FIG. 19.

FIG. 20 is a cross-section C-C from FIG. 19 of the assembly of female connector assembly 48 and circular wire cap assembly 46. This view illustrates the full electrically bonded path between shielded braid 98 of twisted pair cable 78 and posts 138 of grounding base 128. Grounding cable tabs 96 of grounding ring 74 make contact with braid 98 of twisted pair cable 78 at contact point 164. Grounding base tabs 88 of grounding ring 74 make contact with grounding base 128 at contact point 166. Posts 138 of grounding base 128 connect to circuit board 58 (for clarity circuit board 58 is not shown in FIG. 19) thus completing the full path to ground.

Figure 21:
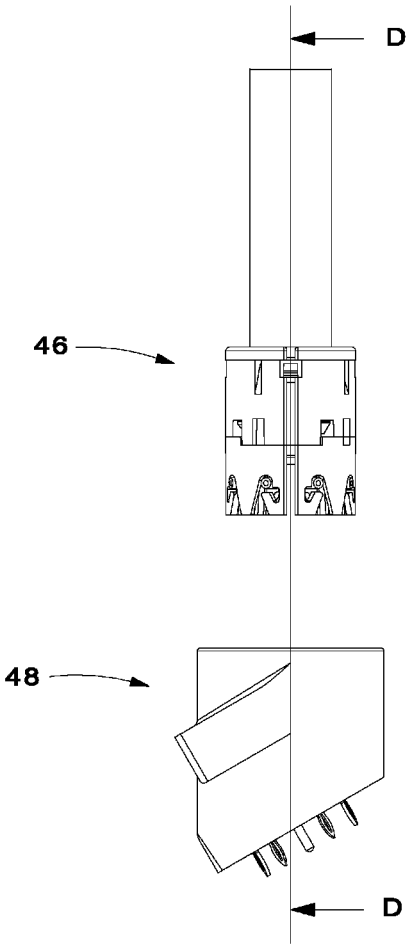
FIG. 21 is an exploded view of the mated connector assembly of FIG. 17.
Figure 22A:
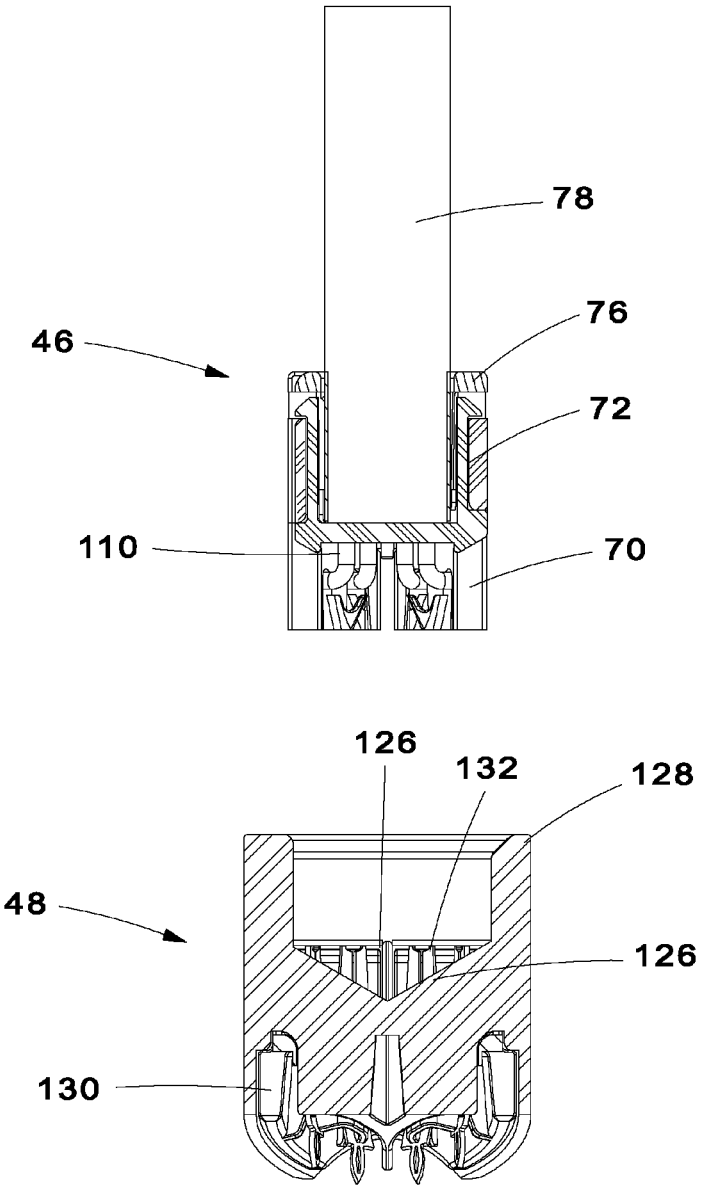
FIGS. 22*a* and 22*b* are cross-sectional views of the mated connector assembly of FIG. 17 taken along line D-D of FIG. 21.
Figure 22B:
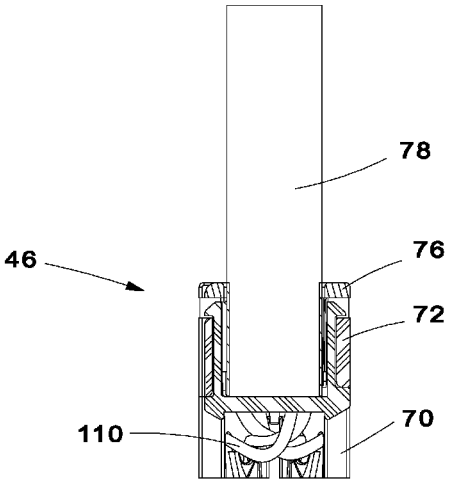
Figure 22B:
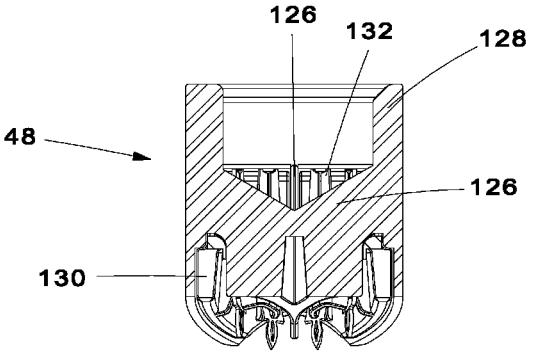

FIG. 21 is an exploded view of female connector assembly 48 and circular wire cap assembly 46. FIG. 22*a* and FIG. 22*b* are cross-section views of FIG. 21 about Section D-D in which FIG. 22*a* and FIG. 22*b* show circular wire cap assembly 46 assembled with opposite ends (two scenarios) of cable 78. These views further show how grounding spacers 126 is angled center to allow for crossover pairs on opposite ends of female connector assembly 48, while still maintaining electrical isolation.

Figure 23:
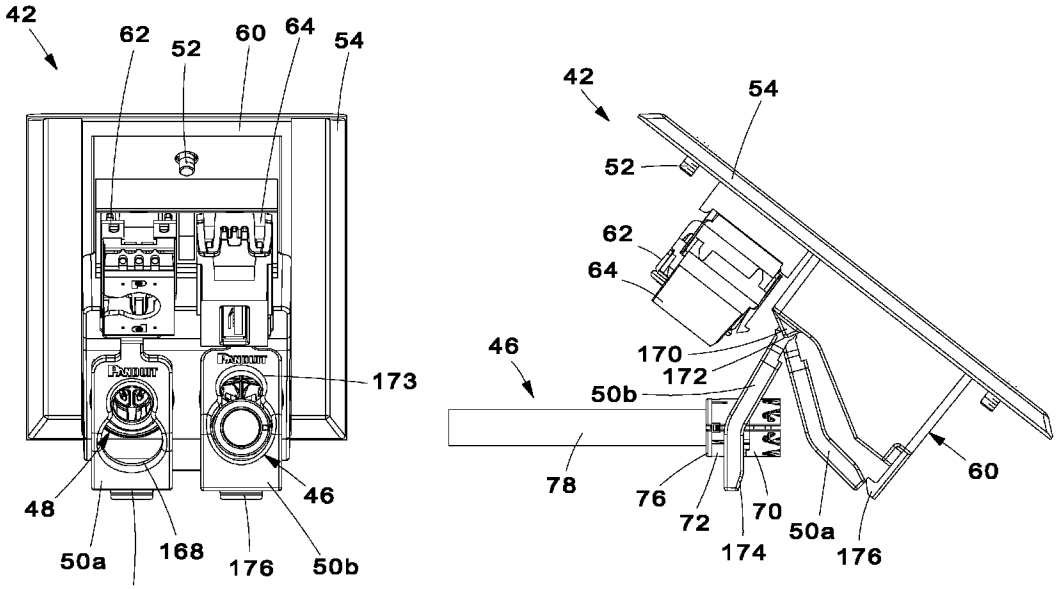
FIGS. 23 and 24 are rotated rear and side view of the faceplate FIG. 1 with the termination levers in two different orientations.
Figure 24:
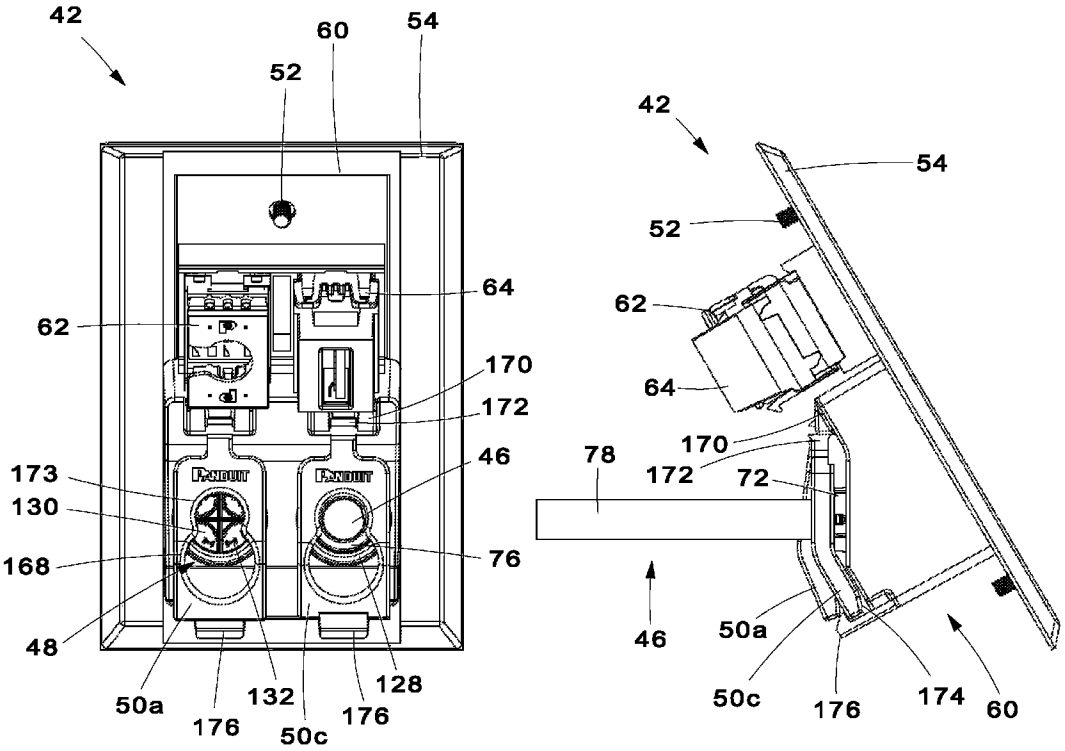

FIG. 23 is a rotated rear and side views of faceplate assembly 42, with termination levers 50 in two different orientations. Termination lever 50*a* is in the unloaded position, and termination lever 50*b* is the position needed to insert circular wire cap assembly 46 through large slot 168 of termination lever 50. Termination lever 50 rotates about hinge 170, and is secured by hook 172. FIG. 24 is a rotated view of communication system 40 and its projection, with termination levers 50 in two different orientations. Termination lever 50*a* is in the unloaded position, and termination lever 50*b* is in the terminated position. Termination lever 50 is rotated such that the bottom surface pushes on cover cap 76 of circular wire cap assembly 46 in order to generate the force needed such that IDCs 132 make electrical contact with conductors 110. Once circular wire cap assembly 46 is terminated, twisted pair cable 78 passes through small slot 173 without interference. In order to insure a complete termination lip 174 must clear flexible latch 176, which forces termination cap 70 to bottom out on surface 150 of standoff 130.

Figure 25:
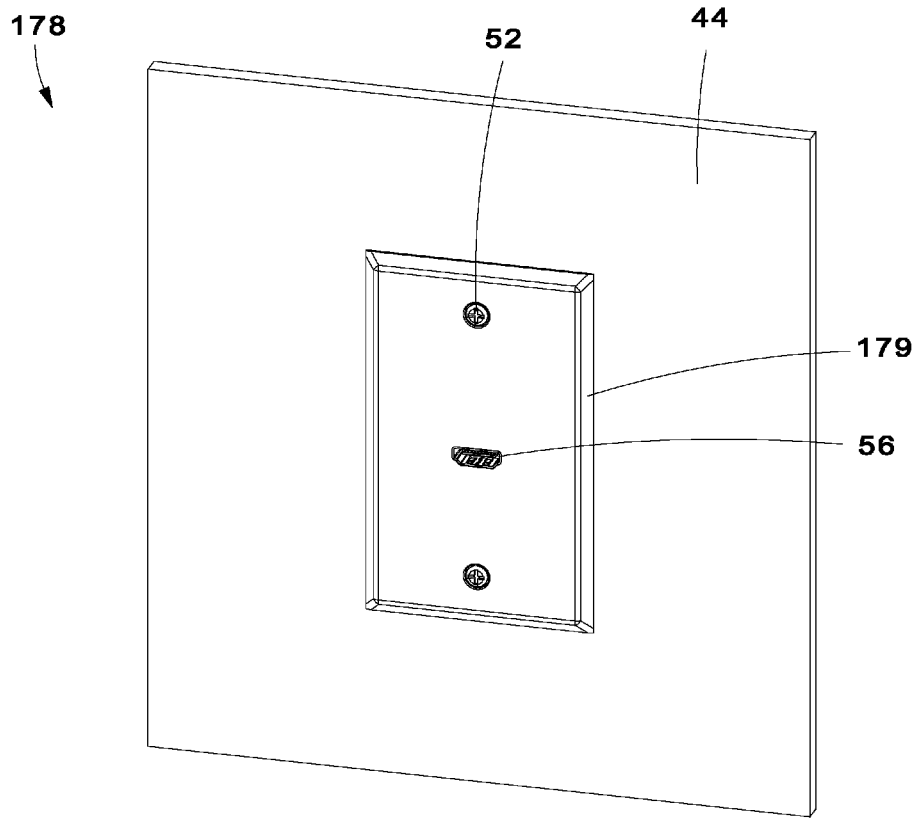
FIG. 25 is a front view of a first alternate faceplate.
Figure 26:
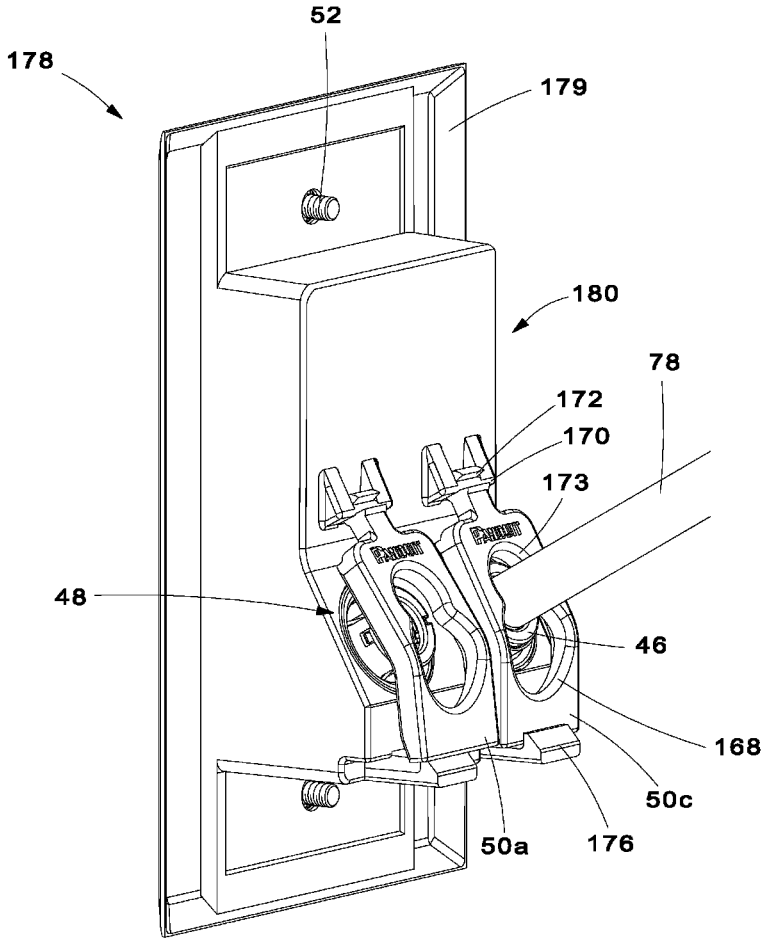
FIG. 26 is a rear isometric view of the faceplate of FIG. 25.

As described above, the present invention can have mounting options for keystone modules. FIG. 25 is a front isometric view of communication system 178 according to a first alternate embodiment of the present invention. FIG. 26 is a rear isometric view of communication system 178. Communication system 178 replaces faceplate backing 60 with faceplate backing 180, and faceplate 54 with faceplate 179, and no longer has an option for mounting of keystone modules.

Figure 27:
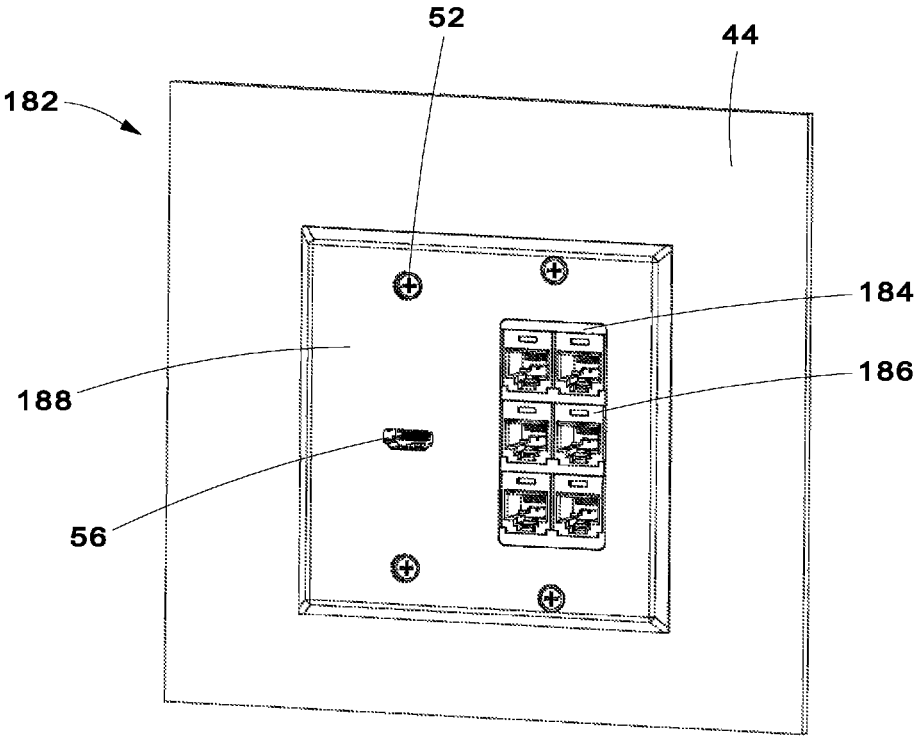
FIG. 27 is a top level isometric view a second alternate faceplate.
Figure 28:
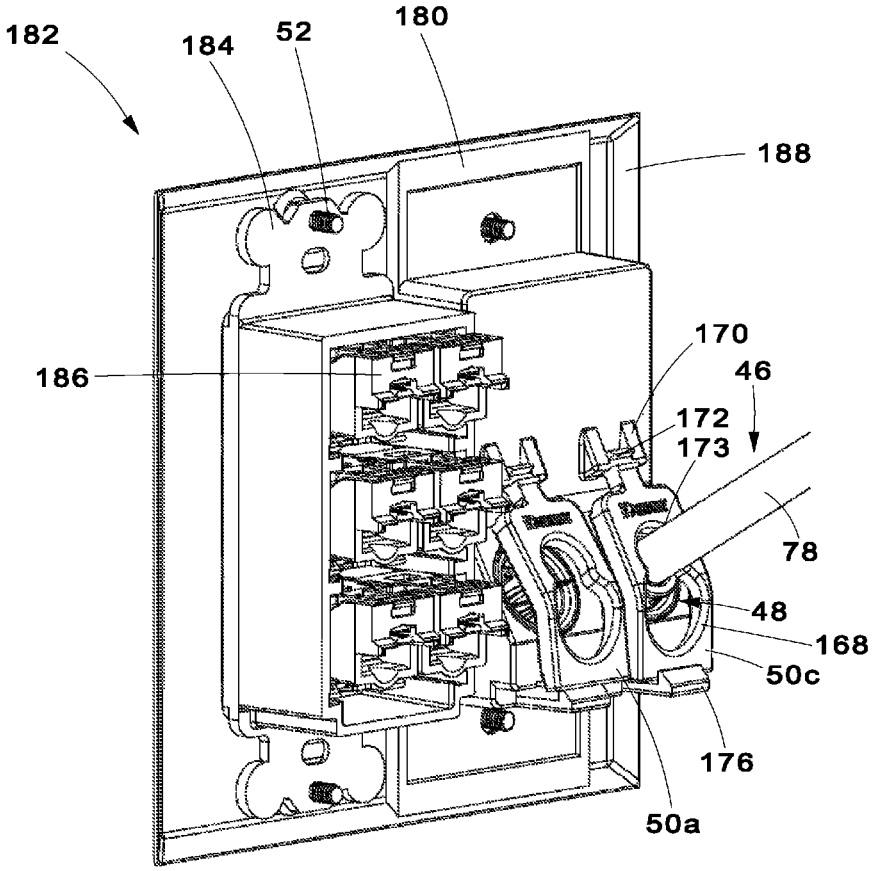
FIG. 28 is a rear isometric view of the faceplate of FIG. 27.

The present invention has been shown used in single gang faceplates only, however this solution may be used in any non-limiting gang of faceplates. FIG. 27 is a top level isometric view of a second alternate embodiment showing communication system 182. FIG. 28 is a rear isometric view of communication system 182. Communication system 182 is shown paired with a GFCI faceplate 184 populated with RJ45 modules 186 which is mounted to double gang faceplate 188. Although communication systems 182 is shown paired with a GFCI faceplate, system 182 can include other faceplate backing 60 or 180 in any non-limiting combination. Modules 186 are shown as Panduit Mini-Com RJ45 network jacks however they may have included any non-limiting modules examples of which include USB, Fiber, AV modules, and others.

The present invention has been shown as a fully shielded assembly; however, in many applications shielding may not be required so in order to reduce the amount of components and end cost of the assembly, the solution can be used as an unshielded solution.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A communication system, comprising:

a support;

a communication connector assembly connected to the support, the connector assembly including a termination lever having an opening; and a communication cable having a plurality of wires and a wire cap assembly wherein the opening of the termination lever is configured to engage the wire cap assembly for terminating the communication cable to the communication connector assembly.

2. The communication system of claim 1, wherein the wire cap assembly includes a cover cap.

3. The communication system of claim 2, wherein the cover cap latches to the connector assembly when the wire cap assembly and the communication cable is terminated to the communication connector assembly.

4. The communication system of claim 1, wherein the support further includes a mounting surface for mounting the communication connector assembly, the communication connector assembly includes a port for receiving the wire cap assembly and the communication cable, and a central axis of the port is non-normal to the front surface.

5. The communication system of claim 4, wherein the central axis of the port is approximately 45° to the front surface.

6. The communication system of claim 4, wherein the communication connector assembly further includes a plurality of isolated quadrants within the port.

7. The communication system of claim 1, wherein the wire cap assembly includes at least one pair of a primary hook and a respective secondary hook for at least one of the plurality of cable conductors, the at least one pair having the primary hook oriented opposite to the respective secondary hook and inhibiting a respective connected conductor release.

8. The communication system of claim 1, wherein the wire cap assembly includes a divider crossbar.

9. The communication system of claim 8, wherein the divider crossbar includes cable posts.

10. The communication system of claim 1, wherein the support is at least one of a faceplate, a patch panel, a surface mount box, or a media distribution unit.

11. A method of connecting a communication cable to a communication connector assembly, the method comprising the steps of:

wire mapping a plurality of conductors into a wire cap assembly;

inserting the wire cap assembly through an opening of a termination lever of the communication connector assembly;

pressing a termination lever of the communication connector assembly; and terminating the plurality of conductors into the communication connector assembly.

12. The method of claim 11, wherein the terminating step connects each of the plurality of conductors to respective ones of a plurality of insulation displacement contacts.

* * * * *